US010888732B2

(12) United States Patent
Miller et al.

(10) Patent No.: US 10,888,732 B2
(45) Date of Patent: Jan. 12, 2021

(54) EXERCISE DEVICE LIMB INTERFACE

(71) Applicant: Proteus Motion Inc., Brooklyn, NY (US)

(72) Inventors: Samuel Adam Miller, Mount Pleasant, SC (US); Michael Charpin, Brooklyn, NY (US); Anthony Alexander Kolodzinski, Massapequa Park, NY (US); Christopher Grigg, Brooklyn, NY (US)

(73) Assignee: Proteus Motion Inc., Brooklyn, NY (US)

( * ) Notice: Subject to any disclaimer, the term of this patent is extended or adjusted under 35 U.S.C. 154(b) by 0 days.

(21) Appl. No.: 16/177,024

(22) Filed: Oct. 31, 2018

(65) Prior Publication Data

US 2019/0126092 A1 May 2, 2019

Related U.S. Application Data

(60) Provisional application No. 62/580,177, filed on Nov. 1, 2017.

(51) Int. Cl.

| | |
|---|---|
| ***A63B 21/00*** | (2006.01) |
| ***A63B 24/00*** | (2006.01) |
| *A63B 21/005* | (2006.01) |

(52) U.S. Cl.

CPC ..... *A63B 21/4035* (2015.10); *A63B 21/151* (2013.01); *A63B 21/4043* (2015.10);

(Continued)

(58) Field of Classification Search

CPC ..... A63B 21/0056; A63B 21/151; A63B 21/4035; A63B 21/4017; A63B 21/4049;

(Continued)

(56) References Cited

U.S. PATENT DOCUMENTS 4,577,862 A 3/1986 Sagedahl
5,080,349 A * 1/1992 Vittone ..... A63B 23/14 482/106

(Continued)

FOREIGN PATENT DOCUMENTS

EP 0544935 A1 9/1993
WO 2005074371 A2 8/2005

(Continued)

OTHER PUBLICATIONS

Troy Barbell SBTB-10 VTX SupraBar Butterfly Tri-Bar With Revolving Handles, Product Specifications, Walmart, 2018.

(Continued)

*Primary Examiner* — Megan Anderson
(74) *Attorney, Agent, or Firm* — Hamilton, Brook, Smith & Reynolds, P.C.

(57) ABSTRACT

A limb interface device for an exercise apparatus includes a handle member within an inner frame member rotatable about a first axis with a first joint, for gripping by a user. At least one outer support member supports the inner frame member. The inner frame member is rotatable about a second axis orthogonal to the first axis with a second joint. An outer arc member supports the at least one support member. The at least one support member is rotatable about a third axis orthogonal to the second axis with a third joint. An arm member supports the outer arc member. The outer arc member can rotate about a fourth axis that is orthogonal to the third axis with a fourth joint. The arm member can also be rotatable about a fifth axis that is longitudinal to the arm member and orthogonal to the fourth axis with a fifth joint.

20 Claims, 6 Drawing Sheets

(52) U.S. Cl.
CPC ..... *A63B 21/4049* (2015.10); *A63B 24/0087* (2013.01); *A63B 21/0056* (2013.01); *A63B 21/4017* (2015.10); *A63B 21/4019* (2015.10); *A63B 21/4021* (2015.10)

(58) Field of Classification Search
CPC ..... A63B 21/4043; A63B 21/4021; A63B 21/4019; A63B 24/0087
See application file for complete search history.

(56) References Cited

U.S. PATENT DOCUMENTS

| | | | | |
|---|---|---|---|---|
| 5,193,963 | A | 3/1993 | McAffee et al. | |
| 5,399,133 | A * | 3/1995 | Haber | A63B 21/4035 482/115 |
| 5,407,405 | A | 4/1995 | Oren | |
| 5,466,213 | A | 11/1995 | Hogan et al. | |
| 5,755,645 | A | 5/1998 | Miller et al. | |
| 6,921,352 | B1 * | 7/2005 | Stearns | A63B 21/00 482/44 |
| 7,108,641 | B2 * | 9/2006 | Pertegaz-Esteban | A63B 23/12 482/100 |
| 7,837,599 | B2 | 11/2010 | Kowalczewski et al. | |
| 7,935,028 | B2 * | 5/2011 | Ketomaki | A63B 22/001 482/139 |
| 8,177,732 | B2 | 5/2012 | Einav et al. | |
| 8,214,029 | B2 | 7/2012 | Koeneman et al. | |
| 8,540,652 | B2 | 9/2013 | Tong et al. | |
| 9,446,288 | B1 | 9/2016 | Pazan | |
| 9,463,347 | B2 | 10/2016 | Kristiansen | |
| 9,861,856 | B1 | 1/2018 | Miller et al. | |
| 10,159,871 | B2 | 12/2018 | Miller et al. | |
| 2004/0082448 | A1 | 4/2004 | Martin | |
| 2012/0152055 | A1 | 6/2012 | Lechuga Priego | |
| 2017/0157457 | A1 * | 6/2017 | Kurabieski | A63B 23/03525 |
| 2019/0209892 | A1 | 7/2019 | Miller et al. | |
| 2020/0188724 | A1 * | 6/2020 | Bauerle | A63B 21/4035 |

FOREIGN PATENT DOCUMENTS

| | | | |
|---|---|---|---|
| WO | 2006082584 | A2 | 8/2006 |
| WO | 2016020457 | A1 | 2/2016 |
| WO | 2017222729 | A1 | 12/2017 |

OTHER PUBLICATIONS

Troy VTX Suprabar Cable Curl Bar With Revolving Handles, Product Specifications, Adamant Barbell, 2017.

* cited by examiner

EXERCISE DEVICE LIMB INTERFACE

RELATED APPLICATION(S)

This application claims the benefit of U.S. Provisional Application No. 62/580,177, filed on Nov. 1, 2017. The entire teachings of the above application(s) are incorporated herein by reference.

BACKGROUND

Handle or limb interfaces for exercise machines in the prior art have been deficient in comfortably and realistically exercising complex motions, such as exercising a throwing motion. Some prior interfaces have caused pain or discomfort to the user's hand, inability to complete a movement, or locking and/or flipping of joints.

SUMMARY

The present invention can provide a limb interface device for an exercise apparatus that can allow complex motions to be exercised without uncomfortable or undesirable positions of the limb interface occurring while being held by the user during exercise. The limb interface device can be attached to a computerized exercise apparatus such as in U.S. Pat. Nos. 5,755,645 and 9,861,856.

The limb interface device can include a handle member mounted within an inner frame member and can be rotatable about a first axis with a first joint, for gripping with one or two hands by a user. The first joint can be limited to about 40° or less rotation. At least one outer support member can support the inner frame member. The inner frame member can be rotatable about a second axis orthogonal to the first axis with a second joint. An outer arc member can support the at least one support member. The at least one support member can be rotatable about a third axis orthogonal to the second axis with a third joint. An arm member can support the outer arc member. The outer arc member can rotate about a fourth axis that is orthogonal to the third axis with a fourth joint. The fourth joint can allow rotation of about 180° or less rotation and is associated with a centering biasing arrangement for resiliently biasing the outer arc member towards a centered position when rotated. The arm member can also be rotatable about a fifth axis that is longitudinal to the arm member and orthogonal to the fourth axis with a fifth joint. The arm member for extending from the exercise apparatus.

In particular embodiments, the inner frame member can include a ring within which the handle member is mounted. The ring can be rotatably mounted between a pair of outer support members. The centering biasing arrangement can include a coil spring secured to and extending along an outer perimeter of the outer arc member for biasing the outer arc member. In some embodiments, the coil spring can be substituted by using a rubber bungee member or other similar mechanism. The outer arc member can slidably pass through the fourth joint in an arc. The outer arc member can comprise a semicircular ring that engages rollers positioned within the arm member. The handle member can be rotatably mounted about the first axis to an inner race of a bearing that is rotatable about the second axis within an outer race of the bearing. The pair of outer support members can be secured to and support the outer race of the bearing. In some embodiments, the arm member can be mounted to a movable arm of a computerized exercise device. In other embodiments, the arm member can be mounted to a cable of an exercise device.

The present invention can also provide a limb interface device having a handle member mounted within an inner frame member and can be rotatable about a first axis with a first joint, for gripping with one or two hands by a user. The first joint can be limited to about 180° or less rotation. At least one outer support member can support the inner frame member. The inner frame member can be rotatable about a second axis orthogonal to the first axis with a second joint. An outer arc member can support the at least one support member. The at least one support member can be rotatable about a third axis orthogonal to the second axis with a third joint. An arm member can support the outer arc member. The outer arc member can rotate about a fourth axis that is orthogonal to the third axis with a fourth joint. The fourth joint can allow rotation of about 180° or less rotation and be associated with a centering biasing arrangement for resiliently biasing the outer arc member towards a centered position when rotated.

In particular embodiments, the inner frame member can include a ring within which the handle member is mounted. The ring can be rotatably mounted between a pair of outer support members. The centering biasing arrangement can include a biasing member associated with the outer arc member for biasing the outer arc member. The outer arc member can slidably pass through the fourth joint in an arc.

The present invention can also provide a method of using a limb interface device for an exercise apparatus including gripping a handle member with one or two hands of the user. The handle member can be mounted within an inner frame member and be rotatable about a first axis with a first joint. The first joint can be limited to about 40° or less rotation. Rotation of the inner frame member can be allowed relative to at least one support member supporting the inner frame member. The inner frame member can be rotatable about a second axis orthogonal to the first axis with a second joint. Rotation of the at least one support member can be allowed relative to an outer arc member that supports the at least one support member. The at least one support member can be rotatable about a third axis orthogonal to the second axis with a third joint. Rotation of the outer arc member can be allowed relative to an arm member that supports the outer arc member. The outer arc member can be rotatable about a fourth axis that is orthogonal to the third axis with a fourth joint. The fourth joint can have rotation of about 180° or less rotation and is associated with a centering biasing arrangement for resiliently biasing the outer arc member towards a centered position when rotated. Rotation of the arm member can be allowed about a fifth axis that is longitudinal to the arm member and orthogonal to the fourth axis with a fifth joint. The arm member for extending from the exercise apparatus.

In particular embodiments, the inner frame member can include a ring within which the handle member is mounted. The ring can be rotatably mounted between a pair of outer support members. The centering biasing arrangement can include a coil spring secured to and extending along an outer perimeter of the outer arc member for biasing the outer arc member. In some embodiments, the coil spring can be substituted by using a rubber bungee member or other similar mechanism. The outer arc member can slidably pass through the fourth joint in an arc. The outer arc member can comprise a semicircular ring that engages rollers positioned within the arm member. The handle member can be rotatably mounted about the first axis to an inner race of a bearing that is rotatable about the second axis within an outer race of the bearing. The pair of outer support members can be secured to and support the outer race of the bearing. In some embodiments, the arm member can be mounted to a movable arm of a computerized exercise device. In other embodiments, the arm member can be mounted to a cable of an exercise device. Further details of the present invention limb interface can be found in the attached description and drawings. Embodiments of the limb interface can have axes of rotation, such as axes $X_1$, $X_2$, $X_3$, $X_4$, and $X_5$. In some embodiments, axes $X_2$ and $X_4$ can coincide, and in other embodiments can be apart.

BRIEF DESCRIPTION OF THE DRAWINGS

The foregoing will be apparent from the following more particular description of example embodiments, as illustrated in the accompanying drawings in which like reference characters refer to the same parts throughout the different views. The drawings are not necessarily to scale, emphasis instead being placed upon illustrating embodiments.

DETAILED DESCRIPTION

Figure 1:
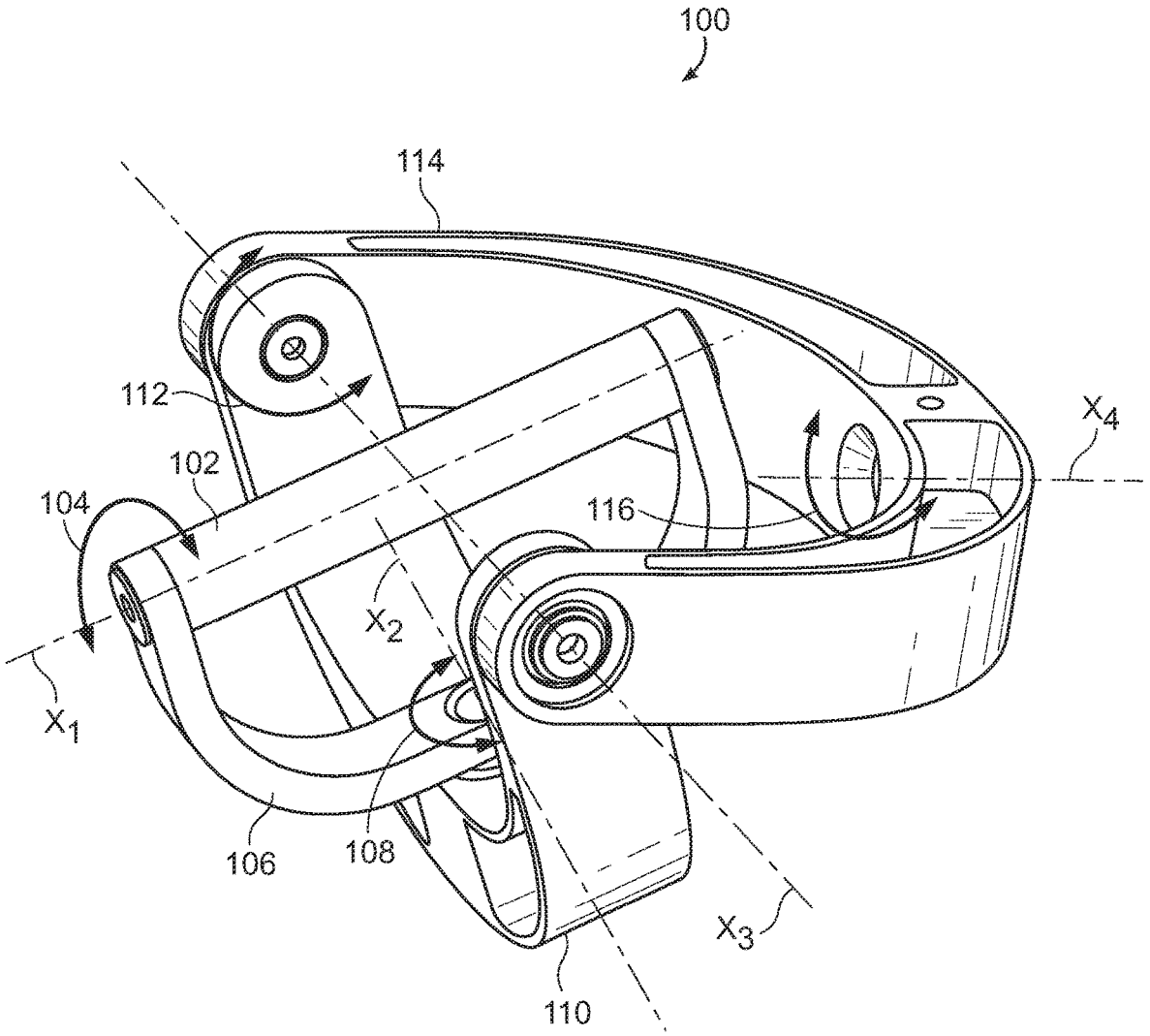
FIG. 1 PRIOR ART
FIG. 1 is a perspective view of an exercise handle in the prior art.

Exercise handles in the prior art have been used with exercise machines for gripping by the user while performing exercises. Referring to FIG. 1, in the prior art, exercise handle 100 can have a handle grip 102 that is rotatably mounted to a first handle member 106 and is rotatable about a first axis $X_1$ in the direction of arrows 104. The first handle member 106 is rotatably mounted to a second handle member 110, and is rotatable about a second axis $X_2$ in the direction of arrows 108. The second handle member 110 is rotatably mounted to a third handle member 114 and is rotatable about a third axis $X_3$ in the direction of arrows 112. The third handle member 114 is rotatably mounted to the desired exercise machine and is rotatable about a fourth axis $X_4$ in the direction of arrows 116. Although the exercise handle 100 has four axes of rotation, when a user is exercising a complex motion such as a throwing motion, a problem known as gimbal lock typically occurs, adversely affecting the exercise.

Gimbal lock can occur when joints align in the exercise handle 100, creating unintended contact with and interference with the user's arm or wrist. Gimbal lock can also cause elements or members of the exercise handle 100 to flip or swing, increasing inertia, causing unpleasant jerking sensations, or making contact with the user's wrist. The flipping due to a gimbal lock condition is known as a wrist singularity. At times, two of the axes of rotation of the exercise handle 100 can become parallel. When this condition occurs, the remaining axes of rotation of the exercise handle 100 attempts to rotate through a large angle as quickly as possible to maintain the wrist orientation, thus causing an unexpected flip of an outer member of the handle. This flipping from gimbal lock then forces other mechanical joints of the exercise handle 100 to adapt due to directional stress, adding torque within the joints, where energy is stored, until the gimbal lock is overcome, leading to a release of the torque that forces the joints to rotate at uncomfortable speeds. In many cases, the exercise movement becomes entirely disrupted and is difficult or impossible to complete without making unnatural biomechanical adjustments by the user. Gimbal lock is most problematic for multi-planar movements, especially at high velocities, such as during the performance of a sport specific movement, like simulating throwing a baseball.

Figure 2:
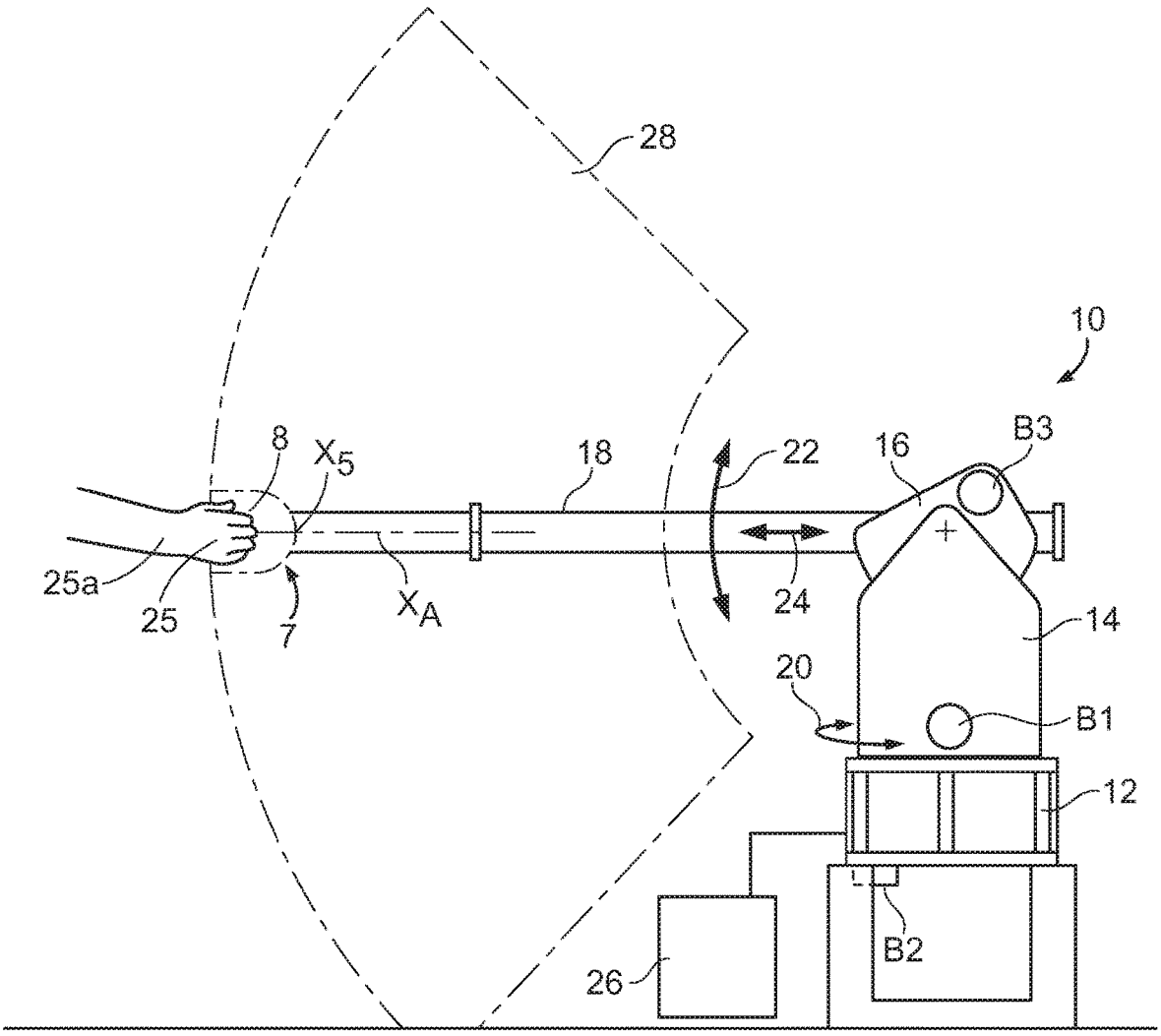
FIG. 2 is a side schematic view of an exercise machine in the present invention.
Figure 3:
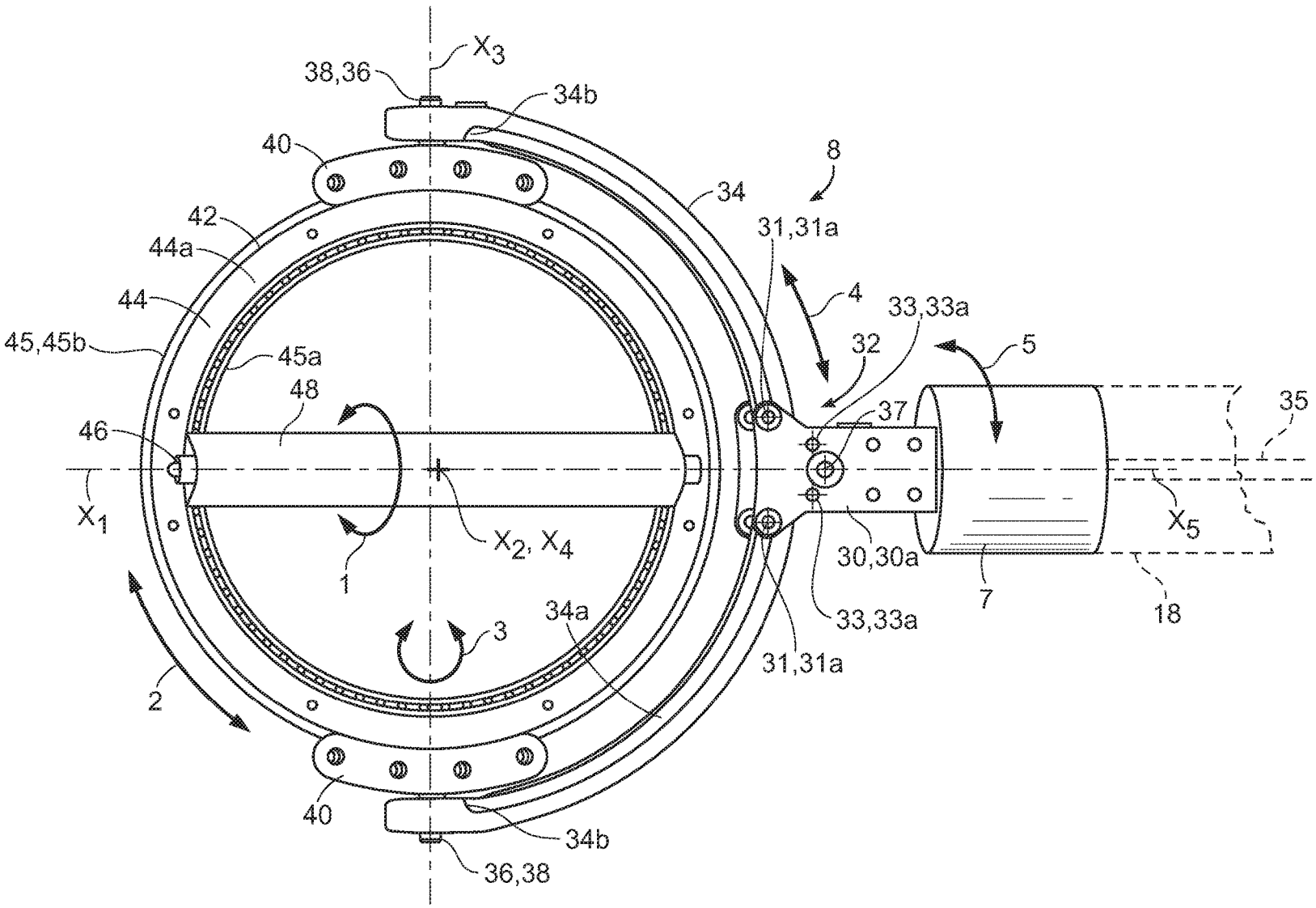
FIG. 3 is a plan view of an embodiment of a limb interface device or handle assembly in the present invention.

FIGS. 2 and 3 show an embodiment of an exercise apparatus or device 10 having a limb interface device or exercise handle assembly 8, in the present invention. The exercise device 10 can be a computerized exercise device such as in U.S. Pat. Nos. 5,755,645 and 9,861,856, the contents of which are incorporated herein by reference in their entirety. Exercise device 10 can include a base 12 with a body member 14 rotatably mounted thereto with a waist joint for side to side rotation in the direction of arrows 20. A shoulder member 16 is rotatably mounted to the body member 14 with a shoulder joint for up-and-down rotation in the direction of arrows 22. An elongate arm or arm member 18 can be mounted to the shoulder member 16 and can slidably extend and retract linearly in the direction of arrows 24. Rotary motion of the shoulder member 16 can be braked or resisted by a computer controlled brake B1, rotary motion of body member 14 can be braked or resisted by a computer controlled brake B2, and linear motion of arm 18 can be braked or resisted by a computer controlled brake B3. Brakes B1, B2 and B3 can be magnetic particle brakes and controlled by a computer or controller 26. A user when gripping the handle assembly 8 with hand 25 (or two hands 25), can move the handle assembly 8 throughout a three-dimensional region of space 28 while experiencing resistance. The novel design of the handle assembly 8 in the present invention, which is further described below, allows the user to exercise complex motions such as a pitching motion without experiencing gimbal lock, so that portions of the handle assembly 8 do not interfere with the user's arm or wrist 25*a*, and flipping of elements or members of the handle assembly 8 does not occur.

The handle assembly 8 can include a gripping or a handle member 48 for gripping with one or two hands 25 of the user. The handle member 48 can be elongate and generally round or cylindrical in shape, and can include a textured or shaped surface for comfortable gripping with a hand 25. The handle member 48 can be rotatably mounted within an inner annular or circular ring-shaped frame member 44 with a first handle rotatable joint 46, and can be rotatable or movable about a first handle axis $X_1$ in a first handle direction indicated by arrows 1. Rotation of the first handle joint 46 can be limited between rotational stops associated with the first joint 46 to be about 180° or less rotation, about 120° or less rotation, or about 60° or less rotation, such as about 40° rotation, which can prevent the circular frame 44 from rotating into and contacting the user's hand 25 during multiplanar or complex movements such as proprioceptive neuromuscular facilitation patterns, for example throwing. In some embodiments, the first joint 46 can be an adjustable joint in which the amount of rotation of the first joint 46 can be adjusted to less than 40°, or in other embodiments more than 40°, and can depend upon the size of circular frame 44. The limited rotation of the first joint 46 can cause other joints in the handle assembly 8 to move to prevent gimbal lock and disruptive movements.

The inner circular ring-shaped frame member 44 can be mounted to or include an annular or circular ring-shaped bearing 45 having inner 45*a* and outer 45*b* races, which can rotate or move relative to each other due to rolling elements therebetween. Bearing 45 is preferably a slewing bearing, but can also be other types of bearings such as standard ball or roller bearings. Frame portion 44*a* of inner frame member 44 can be clamped or secured to the inner race 45*a* of bearing 45 and in some embodiments, can be formed in two pieces or halves. The handle member 48 can be rotatably mounted to the frame portion 44*a* with the first joint 46. In some embodiments, the frame portion 44*a* can cover an inner diameter of inner race 45*a*. The outer race 45*b* of bearing 45 can be supported, secured or clamped by at least one outer support member or clamp 40, for example two on opposite sides 180° apart from each other. As a result, the inner frame member 44 can rotate with the inner race 45*a* of bearing 45 relative to the outer race 45*b* and support clamps 40, in a second handle direction indicated by arrows 2 about a second handle axis $X_2$ that is orthogonal or transverse relative to the first axis $X_1$, with a second handle rotatable joint 42. The second joint 42 is formed by the moving or rotating joint or interface between the inner 45*a* and outer 45*b* races of bearing 45, and can rotate in either direction as much as desired. In some embodiments, the two support clamps 40 can be replaced by single 180° arc shaped clamp. In other embodiments, the bearing 45 can be replaced by rollers mounted to the support clamp(s) 40 that can rotatably capture the inner circular ring-shaped frame member 44.

The support clamp(s) 40 can have two radially outwardly extending pins, shafts or axles 36, which can extend outwardly in opposite directions along a third handle axis $X_3$ into an outer arc shaped frame member 34 to form a third handle rotatable joint 38. The third joint 38 rotatably or movably supports the support clamps 40 (which in turn supports the inner circular ring-shaped frame member 44 and handle member 48), about axis $X_3$ that is orthogonal or transverse to axis $X_2$, and rotatable in a third handle direction indicated by arrows 3. The third joint 38 can rotate or move in either direction as much as desired.

Figure 4:
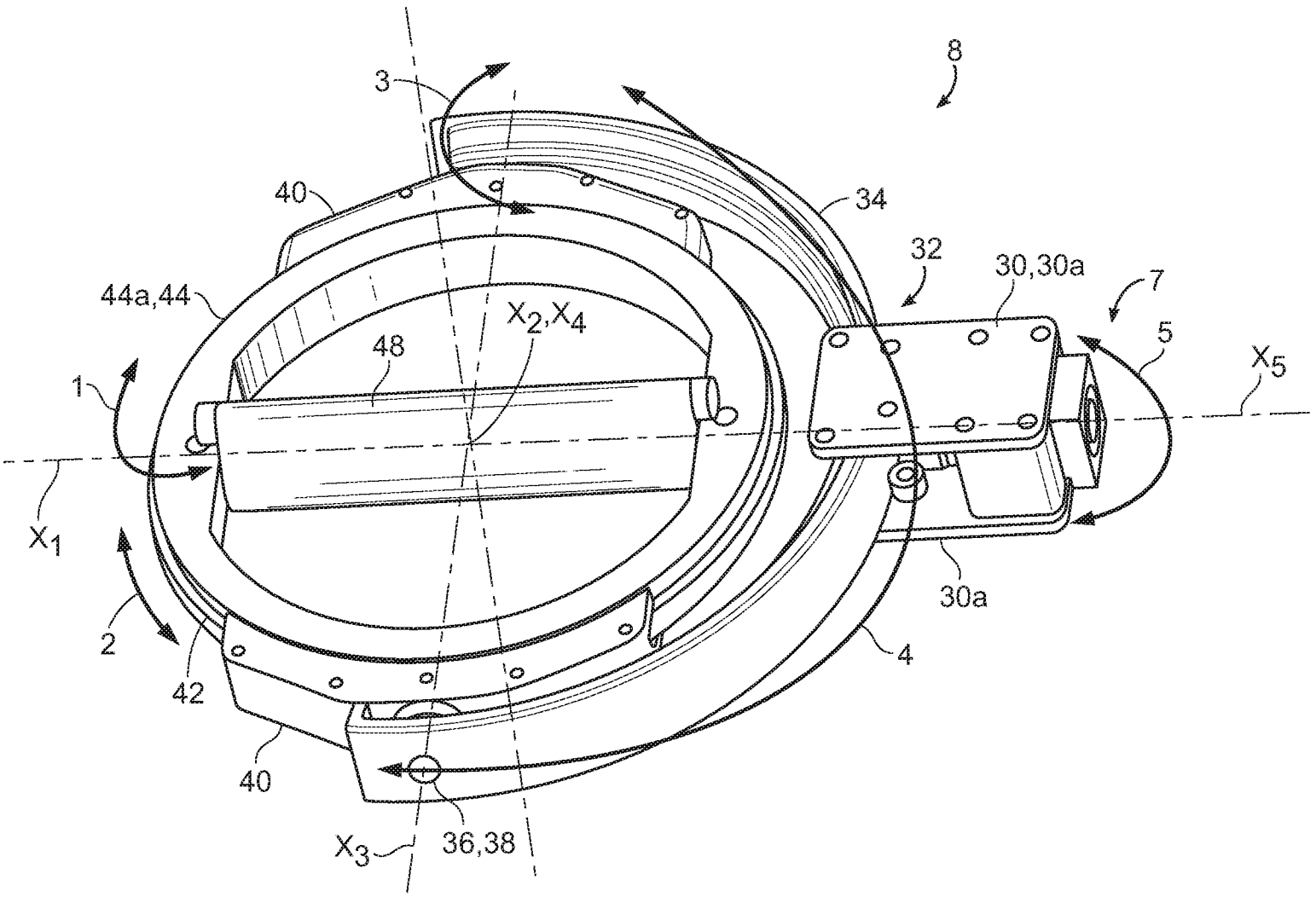
FIG. 4 is a perspective view of a version of the limb interface device of FIG. 3.

The outer arc shaped member 34 can be a semicircular ring or "C" shaped arc segment having about a 180° circular arc. The outer arc member 34 can have a central fourth handle axis $X_4$ orthogonal or transverse to axis $X_3$, that can in some embodiments coincide with axis $X_2$ and be spaced apart from axis $X_3$ (FIG. 3), coincide with axis $X_2$ and intersect axis $X_3$ (FIGS. 4 and 5), or be spaced apart from both axes $X_2$ and $X_3$ (FIG. 6), depending upon the shape, size and spacing of the corresponding components. In some embodiments, when spaced apart, axes $X_2$, $X_3$ and $X_4$ can be considered close enough together to coincide or intersect.

Figure 5:
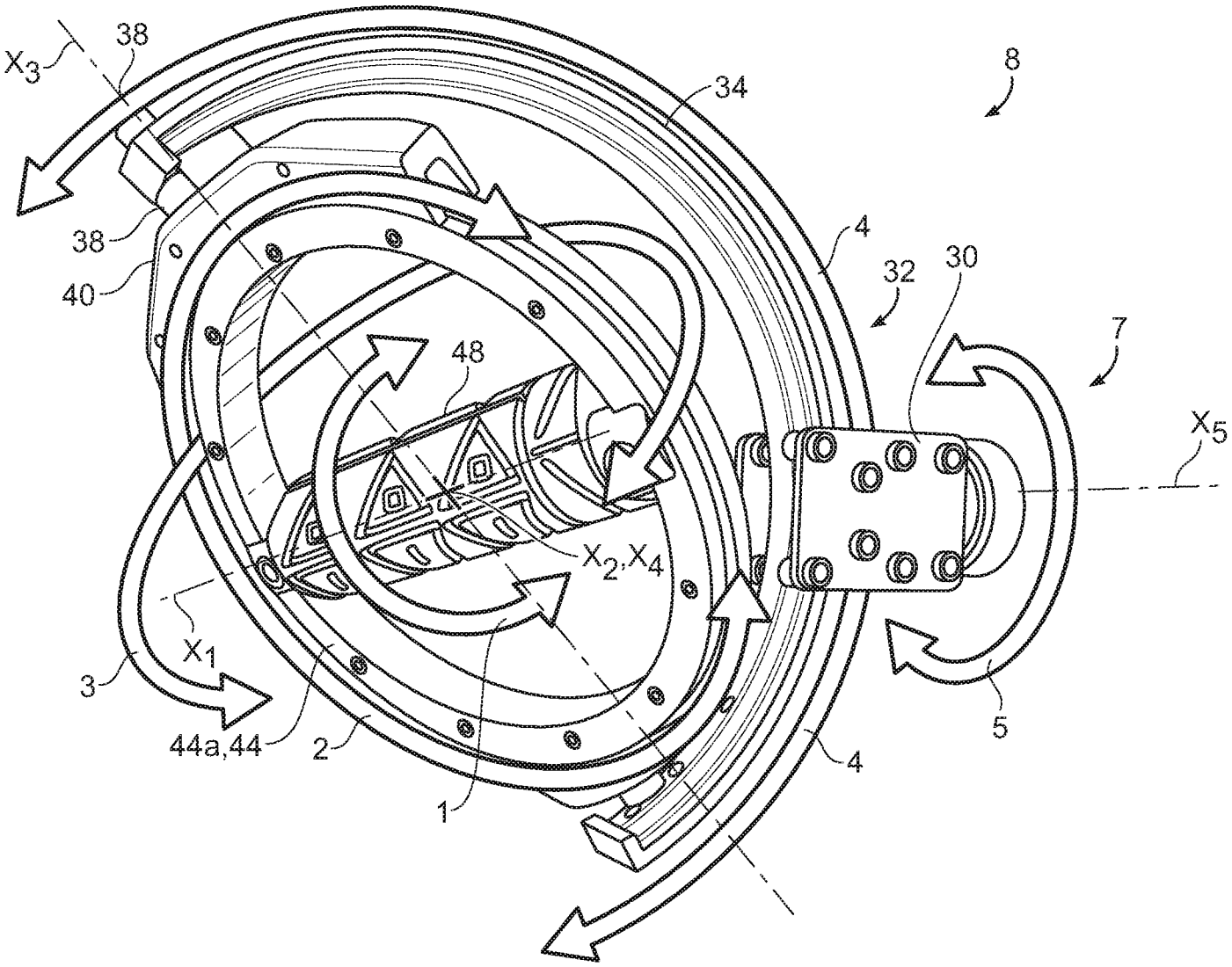
FIG. 5 is a perspective view of another version of the limb interface device of FIG. 3.

An arm or bracket joint member 30 can rollably slidably support the outer arc member 34. The arm member 30 can have two opposed faces or sides 30*a* which can support a series of low friction elements or rotatable rollers 31 and 33 therebetween, that movably, rollably or slidably capture the outer arc member 34 therein, forming a fourth handle joint 32 therebetween. The outer arc member 34 (with the support clamp(s) 40, inner circular ring-shaped frame member 44 and handle member 48) is slidably movable or rotatable about the fourth handle axis $X_4$ by a fourth handle rotatable joint 32 in a fourth handle direction indicated by arrows 4. Two rollers 31 can be rotatable about axes 31*a* and can engage an arched recessed inner surface, step or shoulder 34*a* of the outer arc member 34, and two rollers 33 can be rotatable about axes 33*a* for engaging the outer curved periphery or surface of outer arc member 34, slidably or rollable trapping the outer arc member 34 between the rollers 31 and 33. The opposite ends of the arc inner shoulder 34*a* can have raised radial shoulders or stops 34*b* defining the terminal ends that the outer arc member 34 can travel relative to or within arm member 30 in an arc, about 180° or less before the stops 34*b* engage rollers 31 or arm member 30 and prevent further travel. FIG. 5 depicts movement of the outer arc member 34 closer toward one stop 34*b*. The outer arc member 34 can sometimes travel or rotate about axis $X_4$ in a direction 4 parallel to handle 48 rotatable about axis $X_1$ in direction 1, and/or in a direction parallel to the inner circular ring-shaped frame member 44 rotatable about axis $X_2$ in direction 2, but is always orthogonal or transverse to rotation of inner circular ring-shaped frame member 44 and clamp(s) 40 about axis $X_3$ in direction 3. This can allow the handle assembly 8 to remain adaptive to a user's movement even if some gimbal lock attempts to start to occur. Positioning the rollers 31 and 33 in the arm member 30 positions the weight of the rollers 31 and 33 closer to the end of the arm18 of exercise device 10, and further away from handle member 48, to prevent or minimize additional flipping of elements or members of the handle assembly 8, which can be caused by the weight of bearings positioned closer to the handle member 48 at a longer distance away from shoulder member 16, which can generate higher velocities and momentum.

The arm member 30 can include or can be secured, coupled, connected or mounted to a wrist or fifth handle rotatable joint 7, which in turn can be rotatably secured, coupled, connected or mounted to the arm 18 of the exercise device 10 for rotatably coupling the handle assembly 8 thereto. The wrist joint 7 can move or rotate about a fifth handle axis $X_5$ that is orthogonal or transverse to axes $X_3$ and $X_4$ in a fifth handle direction as indicated by arrows 5. Axis $X_5$ can be aligned with axis $X_A$ of the arm 18 of exercise device 10 to avoid forming offset moment forces relative to axis $X_A$ of the arm 18 of exercise device 10. This can allow precise measurement, control of the resistance, and proper exercise experience of the user exercising with the exercise device 10. In some embodiments, the handle assembly 8 can be used with a cable exercise device, and axis $X_5$ can be aligned with a cable 35 (FIG. 3).

Figure 6:
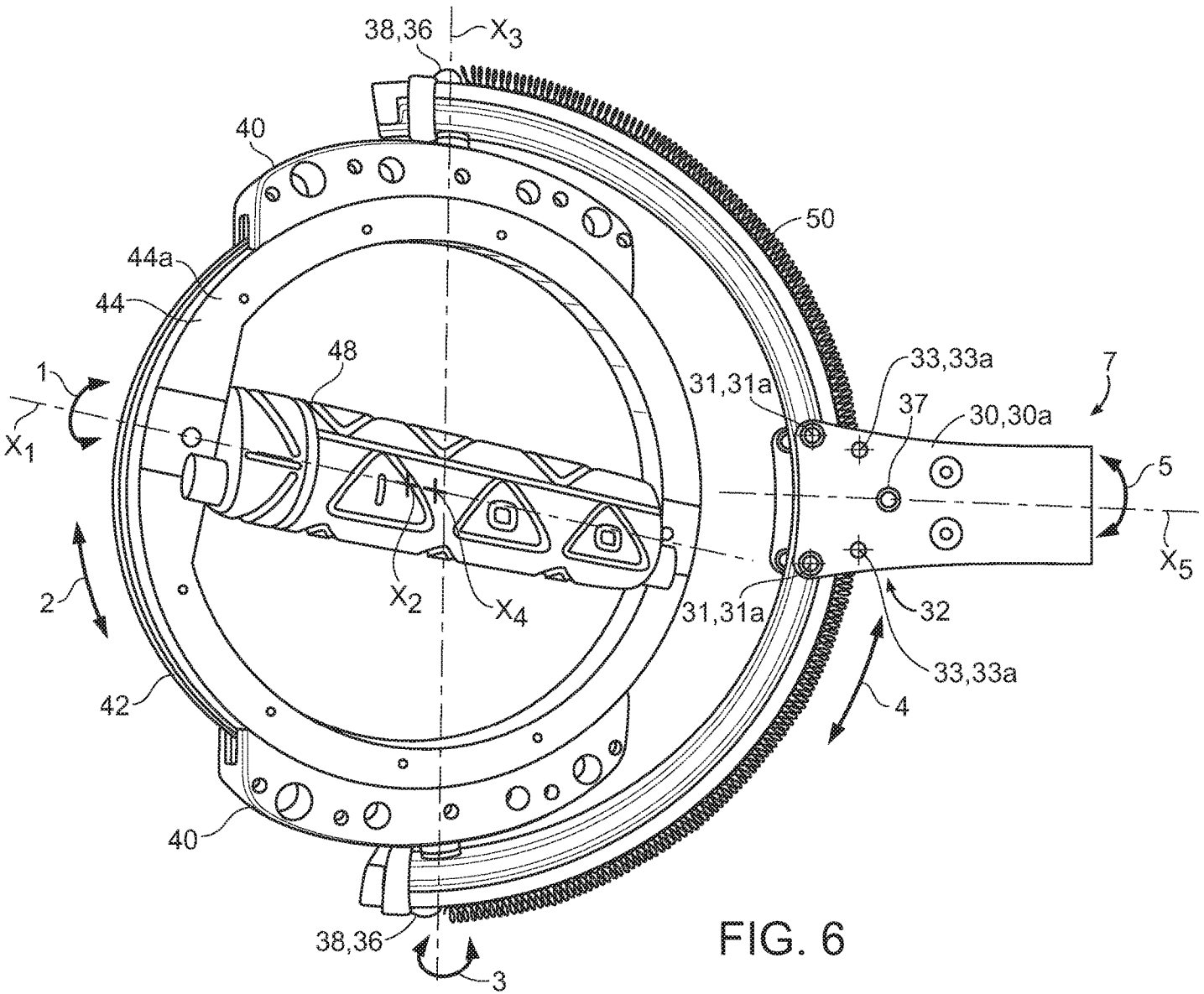
FIG. 6 is a plan view of yet another version of the limb interface device of FIG. 3.

Referring to FIG. 6, in some embodiments, a resilient member such as a coil spring 50 can extend along the outer perimeter surface of the outer arc member 34 and be secured to opposite terminal ends. The midpoint or center of the length or arc of the spring 50 can be secured to the arm member 30 by a securement member or post 37, thereby forming a centering biasing arrangement for biasing the outer arc member 34 towards a centered arc position relative to arm member 30, when rotated away from center. This biasing towards the arc center helps move the fourth joint 32 during exercise toward center for preventing gimbal lock, flipping, or the joint 32 from getting stuck on one side, or end. In one embodiment, two opposing springs 50 of equal length and spring strength can be employed, each extending from opposite ends of outer arc member 34 and terminating, abutting or being secured to post 37. Depending upon the situation, spring(s) 50 can use extension and/or compressive forces for centering. In some embodiments, the spring(s) 50 can be replaced with other resilient members such as rubber bands or bungee members, or other suitable biasing members or mechanisms such as gas piston springs, that can exert an arc centering bias.

The handle assembly 8 has multiple strategically positioned and configured rotational joints about axes, such that when gimbal lock would normally occur in prior art handles, one or more of the other rotational joints engage or move to accommodate the user's natural movement, while also avoiding contact with the user's hand 25. In use, when exercising a complex three-dimensional motion, the user's hand 25 can grip the handle member 48 of handle assembly 8, and move the handle assembly 8 and arm member 18 of exercise device through the motion. As the handle member 48 initially rotates about axis $X_1$ in direction 1, the joints around the other axes $X_2$, $X_3$, $X_4$ and $X_5$ may or may not be rotating. However, once handle member 48 reaches a rotational end point of its rotational limit, 180° or less such as a 40° rotational limit, one or more of the joints around axes $X_2$, $X_3$, $X_4$ and $X_5$ begin to move or rotate as needed to facilitate movement. This prevents handle member 48 from rotating too far with the first joint 46 before the other joints move, and avoids gimbal lock. Depending upon the rotation or orientation of the second and third joints 42 and 38, the axis $X_1$ of handle member 48 can be aligned with axes $X_3$ or $X_5$, and can rotate in the same directions as the third or fifth joints 38 or 7, in directions 3 and 5. In addition, axis $X_1$ can be aligned with or parallel to axis $X_4$, where handle member 48 can rotate in a generally concentrically parallel arc with or relative to outer arc member 34. Since handle member 48 can rotate in the same direction or parallel to these other joints, it can be seen how the limited rotational ability of handle member 48 when its own rotation is stopped, can activate rotation about other axes and joints. The third, fourth and fifth joints 38, 32 and 7 have axes of rotation about axes $X_3$, $X_4$ and $X_5$ that are always orthogonal or transverse to each other. Axis $X_2$ is always orthogonal or transverse to $X_3$, but can be oriented to align with axis $X_5$. Although some of the joints and axes at times can be rotated into orientations to be aligned or redundant, the Applicant has found that having the five joints rotatable about axes $X_1$, $X_2$, $X_3$, $X_4$ and $X_5$ with rotation about axes $X_1$ and $X_4$ being limited to partial rotation, provide a configuration that allows exercise of natural complex three-dimensional arm and hand motions such as a pitching throwing motion in a smooth natural manner without gimbal lock. Faster complex exercises such as a pitching motion are inherently likely to experience gimbal lock in prior art exercise handles, while slow simple motions, such as a weight lifting press or curling motion, often do not. In some embodiments, the fifth joint about axis $X_5$ can be omitted, for example if handle assembly 8 is connected to a cable that can experience rotational twist, or if the exercise device itself has a rotational joint about axis $X_5$.

While example embodiments have been particularly shown and described, it will be understood by those skilled in the art that various changes in form and details may be made therein without departing from the scope of the embodiments encompassed by the appended claims. In some embodiments, the length and/or width of the handle member mounted within an inner frame member can be increased to accommodate movements that involve two hands. This can be useful for sport or other functional movements including swinging a baseball bat or golf club.

What is claimed is:

1. A limb interface device for an exercise apparatus comprising:

a handle member mounted within an inner frame member and rotatable about a first axis with a first joint, for gripping with one or two hands by a user, the first joint being limited to 40° or less rotation;

at least one outer support member supporting the inner frame member, the inner frame member being rotatable about a second axis orthogonal to the first axis with a second joint;

an outer arc member supporting the at least one outer support member, the at least one outer support member being rotatable about a third axis orthogonal to the second axis with a third joint; and an arm member supporting the outer arc member, the outer arc member being rotatable about a fourth axis that is orthogonal to the third axis with a fourth joint, the fourth joint allowing rotation of 180° or less rotation and associated with a centering biasing member interacting with the outer arc member for resiliently biasing the outer arc member towards a centered position when rotated, the arm member also being rotatable about a fifth axis that is longitudinal to the arm member and orthogonal to the fourth axis with a fifth joint, the arm member for extending from the exercise apparatus.

2. The limb interface device of claim 1 in which the inner frame member comprises a ring within which the handle member is mounted, wherein the at least one outer support member comprises a pair of outer support members, the ring is rotatably mounted between the pair of outer support members.

3. The limb interface device of claim 2 in which the handle member is rotatably mounted about the first axis to an inner race of a bearing that is rotatable about the second axis within an outer race of the bearing, the pair of outer support members being secured to and supporting the outer race of the bearing.

4. The limb interface device of claim 1 in which the centering biasing member comprises a coil spring secured to and extending along an outer perimeter of the outer arc member for biasing the outer arc member.

5. The limb interface device of claim 1 in which the outer arc member slidably passes through the fourth joint in an arc.

6. The limb interface device of claim 5 in which the outer arc member comprises a semicircular ring that engages rollers positioned within the arm member.

7. The limb interface device of claim 1 in which the exercise apparatus is computerized and the arm member is mounted to a movable arm of the exercise apparatus.

8. The limb interface device of claim 1 in which the arm member is mounted to a cable of the exercise apparatus.

9. A limb interface device for an exercise apparatus comprising:

a handle member mounted within an inner frame member and rotatable about a first axis with a first joint, for gripping with one or two hands by a user, the first joint being limited to 180° or less rotation;

at least one outer support member supporting the inner frame member, the inner frame member being rotatable about a second axis orthogonal to the first axis with a second joint;

an outer arc member supporting the at least one outer support member, the at least one outer support member being rotatable about a third axis orthogonal to the second axis with a third joint; and an arm member supporting the outer arc member, the outer arc member being rotatable about a fourth axis that is orthogonal to the third axis with a fourth joint, the fourth joint allowing rotation of 180° or less rotation and associated with a centering biasing member interacting with the outer arc member for resiliently biasing the outer arc member towards a centered position when rotated.

10. The limb interface device of claim 9 in which the inner frame member comprises a ring within which the handle member is mounted, wherein the at least one outer support member comprises a pair of outer support members, the ring is rotatably mounted between the pair of outer support members.

11. The limb interface device of claim 9 in which the centering biasing member is secured to the outer arc member for biasing the outer arc member.

12. The limb interface device of claim 9 in which the outer arc member slidably passes through the fourth joint in an arc.

13. A method of using a limb interface device for an exercise apparatus comprising:

gripping a handle member with one or two hands of a user, the handle member being mounted within an inner frame member and rotatable about a first axis with a first joint, the first joint being limited to 40° or less rotation;

allowing rotation of the inner frame member relative to at least one support member supporting the inner frame member, the inner frame member being rotatable about a second axis orthogonal to the first axis with a second joint;

allowing rotation of the at least one support member relative to an outer arc member supporting the at least one support member, the at least one support member being rotatable about a third axis orthogonal to the second axis with a third joint;

allowing rotation of the outer arc member relative to an arm member supporting the outer arc member, the outer arc member being rotatable about a fourth axis that is orthogonal to the third axis with a fourth joint, the fourth joint having rotation of 180° or less rotation and associated with a centering biasing member interacting with the outer arc member for resiliently biasing the outer arc member towards a centered position when rotated; and allowing rotation of the arm member about a fifth axis that is longitudinal to the arm member and orthogonal to the fourth axis with a fifth joint, the arm member for extending from the exercise apparatus.

14. The method of claim 13 in which the inner frame member comprises a ring within which the handle member is mounted, wherein the at least one support member comprises a pair of support members, the ring is rotatably mounted between the pair of support members.

15. The method of claim 14 in which the handle member is rotatably mounted about the first axis to an inner race of a bearing that is rotatable about the second axis within an outer race of the bearing, the pair of support members being secured to and supporting the outer race of the bearing.

16. The method of claim 13 in which the outer arc member slidably passes through the fourth joint in an arc.

17. The method of claim 16 in which the outer arc member comprises a semicircular ring that engages rollers positioned within the arm member.

18. The method of claim 13 in which the centering biasing member comprises a coil spring secured to and extending along an outer perimeter of the outer arc member for biasing the outer arc member.

19. The method of claim 13 in which the exercise apparatus is computerized and the arm member is mounted to a movable arm of the exercise apparatus.

20. The method of claim 13 in which the arm member is mounted to a cable of the exercise apparatus.

* * * * *